US007616159B2

(12) United States Patent
Fu et al.

(10) Patent No.: US 7,616,159 B2
(45) Date of Patent: Nov. 10, 2009

(54) ANTENNA ARRAY

(75) Inventors: Kuo-Chan Fu, Hsin-Tien (TW); Po-Sheng Chen, Hsin-Tien (TW); Tsung-Wen Chiu, Hsin-Tien (TW); Fu-Ren Hsiao, Hsin-Tien (TW)

(73) Assignee: Advanced Connectek Inc., Hsin-Tien, Taipei Hsien (TW)

( * ) Notice: Subject to any disclaimer, the term of this patent is extended or adjusted under 35 U.S.C. 154(b) by 0 days.

(21) Appl. No.: 11/948,222

(22) Filed: Nov. 30, 2007

(65) Prior Publication Data

US 2008/0136713 A1 Jun. 12, 2008

(30) Foreign Application Priority Data

Dec. 8, 2006 (TW) ..... 95221690 U

(51) Int. Cl.
*H01Q 1/38* (2006.01)

(52) U.S. Cl. ..... 343/700 MS; 343/853; 343/815

(58) Field of Classification Search ..... 343/700 MS, 343/795, 797, 815, 853
See application file for complete search history.

(56) References Cited

U.S. PATENT DOCUMENTS

| | | | | |
|---|---|---|---|---|
| 5,734,350 | A * | 3/1998 | Deming et al. | 343/700 MS |
| 6,121,929 | A * | 9/2000 | Olson et al. | 343/700 MS |
| 6,236,367 | B1 * | 5/2001 | Du Toit et al. | 343/700 MS |
| 6,650,301 | B1 * | 11/2003 | Zimmerman | 343/803 |
| 6,788,258 | B2 * | 9/2004 | Olson | 343/700 MS |

* cited by examiner

*Primary Examiner*—Vibol Tan
*Assistant Examiner*—Christopher Lo
(74) *Attorney, Agent, or Firm*—patenttm.us

(57) ABSTRACT

An antenna array has a ground plane, a plurality of spacers, a radiating patch array and a feeding member. The spacers are mounted on the ground plane. The radiating patch array is mounted on the spacers, is separated from the ground plane at an interval and has three pairs of radiating patches. Each radiating patch is parallel to the ground plane and has a sub radiating patch formed on and inclined away from the ground plane. The inclined sub radiating patches and the interval increase gain of the antenna array.

6 Claims, 3 Drawing Sheets

ANTENNA ARRAY

BACKGROUND OF THE INVENTION

1. Field of the Invention

The present invention relates to an antenna, and more particularly to an antenna array that has a ground plane and an array of antenna patches suspended on the ground plane to increase the gains and side-lobe levels of the antenna array.

2. Description of Related Art

A conventional micro-strip antenna has a dielectric substrate, a ground plane and at least one radiating patch. The ground plane is mounted on the dielectric substrate. The at least one radiating patch is substantially a piece of metal sheet, is mounted on the dielectric substrate opposite to the ground plane, is connected to a feed wire and may be rectangular, circular or elliptical. Multiple patches may be mounted on the dielectric substrate and arranged in an array to form an antenna array.

A conventional antenna array has a ground plane, a feeding element and at least one pair of radiating patches. The feeding wire has multiple branches connected respectively to the radiating patches. Signals transmitted into the feeding wire are fed into the radiating patches with phase displacements.

However, to manufacture the antenna array, the feeding wire and radiating patches are printed on the dielectric substrate with the ground plane, which reduces the gains and side-lobe levels of the antenna array.

To overcome the shortcomings, the present invention provides an antenna array to mitigate or obviate the aforementioned problems.

SUMMARY OF THE INVENTION

The main objective of the invention is to provide an antenna array that has a ground plane and an array of antenna patches suspended on the ground plane to increase gain and side-lobe level of the antenna array.

An antenna array in accordance with present invention comprises a ground plane, three pairs of spacers, a radiating patch away and a feeding member. The spacers are mounted on the ground plane. The radiating patch array is mounted on the spacer, is separated from the ground plane at an interval and has three pairs of radiating patches. Each radiating patch is parallel to the ground plane and has a sub radiating patch formed on and inclined away from the ground plane. The inclined sub radiating patches and the interval increase the gains of the antenna array. Other objectives, advantages and novel features of the invention will become more apparent from the following detailed description when taken in conjunction with the accompanying drawings.

DETAILED DESCRIPTION OF THE PREFERRED EMBODIMENT

Figure 1:
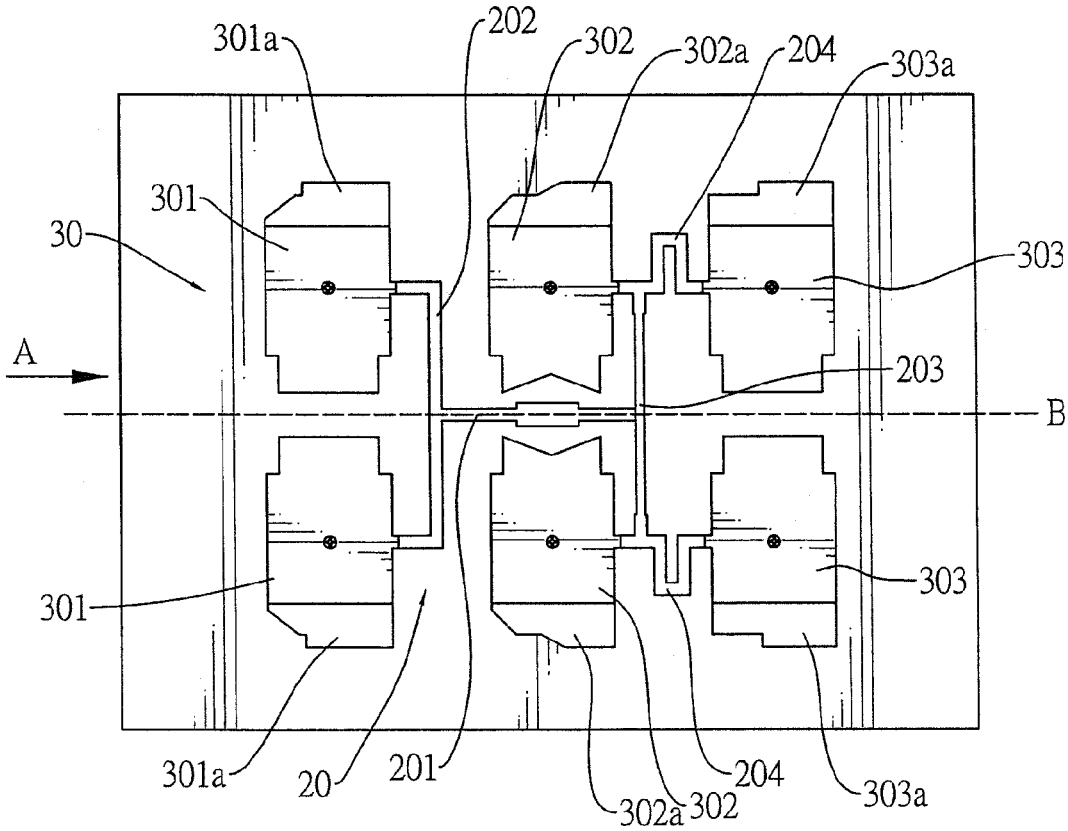
FIG. 1 is a top view of an antenna array in accordance with the present invention.
Figure 2:
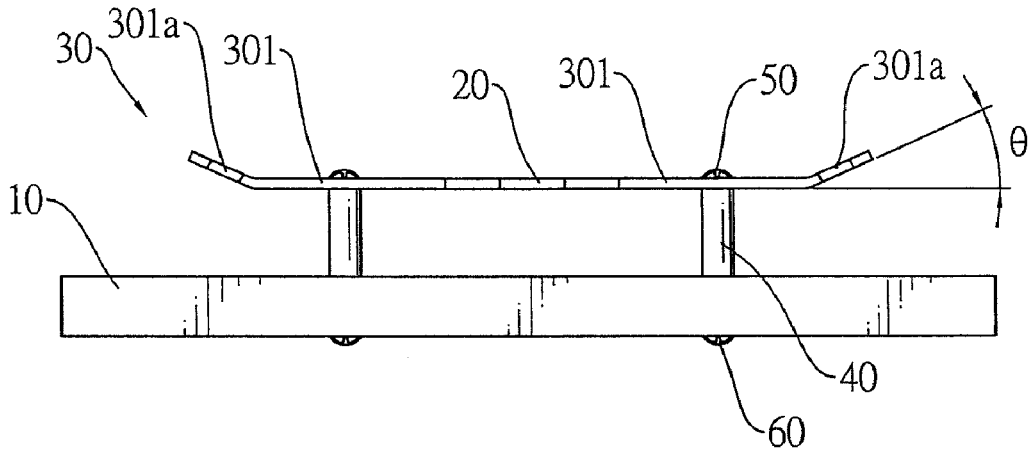
FIG. 2 is an end view of the antenna array seen from the arrow A in FIG. 1 with a first variant of the feeding member and the radiating patch array arranged at the same interval.
Figure 3:
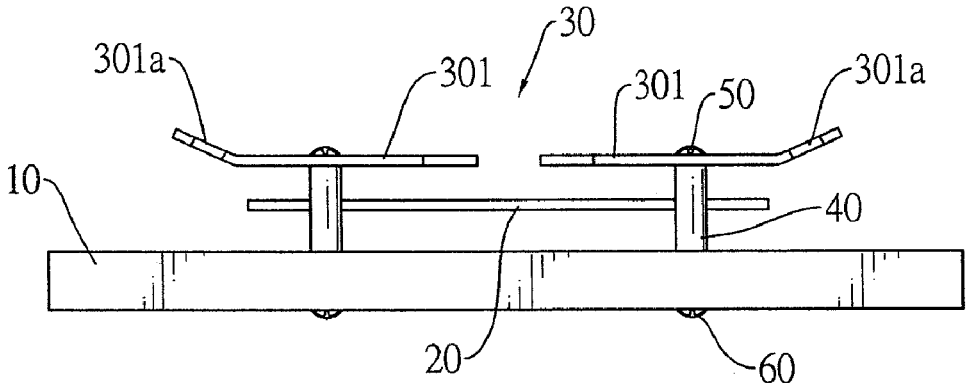
FIG. 3 is an end view of the antenna seen from the arrow A in FIG. 1 with a second variant of the feeding member and the second radiating patch array arranged at different intervals.

With reference to FIGS. 1-3, an antenna in accordance with the present invention comprises a ground plane, multiple spacers (40), a radiating patch array (30) and a feeding member (20).

The ground plane (10) is substantially a piece of metal sheet.

The spacers (40) are mounted on and protrude perpendicularly from the ground plane (10) and each spacer (40) has a top end and a bottom end and may further have a top fastener (50) and a bottom fastener (60). The bottom end of the spacer (40) is mounted securely on the ground plane (10). The top fastener (50) is mounted securely on the top end. The bottom fastener (60) is mounted through the ground plane (10) is mounted securely on the bottom end to hold the spacer (40) on the ground plane (10).

The radiating patch array (30) is mounted securely on the spacers (40), is separated from the ground plane (10) at a first interval and has a pair of first radiating patches (301), a pair of second radiating patches (302) and a pair of third radiating patches (303).

The first, second and third radiating patches (301, 302, 303) of each pair are made of metal, are symmetrical with respect to a symmetrical line (B), are mounted respectively on and held on the top ends of two of the spacers (40) by the top fasteners (50) and are separated from the ground plane (10). Each of the first, second and third radiating patches (301, 302, 303) is parallel to the ground plane (10) and has an inside edge, an outside edge and a sub radiating patch (301*a*, 302*a*, 303*a*). The sub radiating patch (301*a*, 302*a*, 303*a*) is a distal portion having an outside free end, is formed on and protrudes transversely out from the outer edge of the first, second or third radiating patch (301, 302, 303), is separated from the ground plane (10) at the first interval and is inclined away from the ground plane (10) at an included angle (θ) between the first, second or third radiating patch (301, 302, 303) and the sub radiating patch (301*a*, 302*a*, 303*a*). The included angle (θ) is preferably in a range of 20-90 degrees for optimal gains.

The feeding member (20) may be connected to a feed wire or a coaxial cable mounted in an electronic device. The coaxial cable has a positive signal wire connected to the feeding member (20) and a negative signal wire connected to the ground plane (10). The feeding member (20) is made of metal, is separated from the ground plane (10) at a second interval and is connected to the pairs of the first, second and third radiating patches (301, 302, 303). The feeding member (20) and the radiating patch array (30) may be separated from the ground plane (10) at the same interval. In other words, the first interval is equal to the second interval, as shown in FIG. 2. Alternatively, the feeding member (20) may be separated from the ground plane (10) at different intervals. The second interval is smaller than the first interval, as shown in FIG. 3. The feeding member (20) and the radiating patch array (30) may be manufactured simultaneously by stamping. The feeding member (20) may have a central feeding segment (201), a first feeding segment (202) and a second feeding segment (203).

The central feeding segment (201) is longitudinal, is located between the second radiating patches (302) and has a first end and a second end.

The first feeding segment (202) is formed on and protrudes transversely from the first end of the central feeding segment (201) and has two ends connected respectively to the first radiating patches (301).

The second feeding segment (203) is formed on and protrudes transversely from the second end of the central feeding segment (201) and has two end sections (204). Each end section (204) may follow an indirect path and is connected to one second radiating patch (302) and one third radiating patch (303). The indirect path changes the resistance of the end section of the second feeding segments (203) connected to the third radiating patches (303).

The radiating patch array (30) and feeding member (20) separated from the ground plane (10) increases the gains and side-lobe levels of the antenna array. Furthermore, the inclined sub radiating patches (301*a*, 302*a*, 303*a*) also increase the gain of the antenna array.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An antenna array comprising:

a ground plane;

a plurality of spacers, each mounted on and protruding perpendicularly from the ground plane, and having a top end and a bottom end;

a radiating patch array mounted on the spacers, separated from the ground plane at a first interval and having a pair of first radiating patches, a pair of second radiating patches and a pair of third radiating patches, the first, second and third radiating patches of each pair mounted respectively on and held on the top ends of two of the spacers and separated from the ground plane, and each of the first, second and third radiating patches being parallel to the ground plane and having an inside edge;

an outside edge; and a sub radiating patch being a distal portion having an outside free end, formed on and protruding transversely out from the outer edge of the first, second or third radiating patch, separated from the ground plane at the first interval and inclined away from the ground plane at an included angle between the first, second or third radiating patch and the sub radiating patch, and the included angle is in a range of 20 to 90 degrees; and a feeding member separated from the ground plane at a second interval and connected to the pairs of the first, second and third radiating patches.

2. The antenna array as claimed in claim 1, wherein each spacer further has a bottom fastener mounted through the ground plane and mounted securely on the bottom end of the spacer to hold the spacer on the ground plane.

3. The antenna array as claimed in claim 2, wherein each spacer further has a top fastener mounted on the top end of the spacer and holding one of the first, second and third radiating patches.

4. The antenna array as claimed in claim 3, wherein the feeding member further has a central feeding segment being longitudinal, located between the second radiating patches and having a first end and a second end;

a first feeding segment formed on and protruding transversely from the first end of the central feeding segment and having two ends connected respectively to the first radiating patches; and a second feeding segment formed on and protruding transversely from the second end of the central feeding segment and having two end sections, each end section connected to one second radiating patch and one third radiating patch.

5. The antenna array as claimed in claim 4, wherein the second interval is smaller than the first interval.

6. The antenna array as claimed in claim 4, wherein the first interval is equal to the second interval.

* * * * *